US012546173B2

(12) United States Patent
Rose et al.

(10) Patent No.: US 12,546,173 B2
(45) Date of Patent: Feb. 10, 2026

(54) DETACHABLE DIVING BOARD FOR DRILLING RIG

(71) Applicant: Helmerich & Payne, Inc., Tulsa, OK (US)

(72) Inventors: Andrew Rose, Tulsa, OK (US); Michael Brzezniak, Cypress, TX (US)

(73) Assignee: Helmerich & Payne, Inc., Tulsa, OK (US)

( * ) Notice: Subject to any disclaimer, the term of this patent is extended or adjusted under 35 U.S.C. 154(b) by 0 days.

(21) Appl. No.: 18/672,574

(22) Filed: May 23, 2024

(65) Prior Publication Data

US 2024/0392636 A1 Nov. 28, 2024

Related U.S. Application Data

(60) Provisional application No. 63/519,773, filed on Aug. 15, 2023, provisional application No. 63/516,387, filed on Jul. 28, 2023, provisional application No. 63/516,365, filed on Jul. 28, 2023, provisional application No. 63/503,900, filed on May 23, 2023.

(51) Int. Cl.

| | |
|---|---|
| ***E21B 19/00*** | (2006.01) |
| ***E21B 15/00*** | (2006.01) |
| ***E21B 19/14*** | (2006.01) |

(52) U.S. Cl.

CPC ..... *E21B 19/14* (2013.01); *E21B 15/00* (2013.01)

(58) Field of Classification Search

CPC ..... E21B 19/14; E21B 15/00; E21B 15/003; E21B 19/00; E21B 19/155; E21B 19/20; E21B 7/023; E21B 7/02; E21B 3/022

See application file for complete search history.

(56) References Cited

U.S. PATENT DOCUMENTS

| | | | | |
|---|---|---|---|---|
| 2,191,643 A * | 2/1940 | Deckard | E21B 19/14 182/222 |
| 2,311,932 A * | 2/1943 | Deckard | E21B 19/14 211/100 |
| 2,634,405 A * | 4/1953 | Stone | E21B 19/02 340/685 |
| 6,634,436 B1 | 10/2003 | Desai | |
| 8,814,487 B2 * | 8/2014 | Yater | E21B 19/14 414/22.65 |

(Continued)

FOREIGN PATENT DOCUMENTS

WO 2020160440 A1 8/2020

OTHER PUBLICATIONS

PCT/US2024/030887, "International Search Report and Written Opinion", Aug. 19, 2024, 8 pages.

*Primary Examiner* — Kipp C Wallace

(74) *Attorney, Agent, or Firm* — Kilpatrick Townsend & Stockton LLP

(57) ABSTRACT

A drilling rig assembly and methods of assembling a drilling rig are described. The drilling rig assembly can include a mast, a racking board removably coupleable to the mast, and a diving board configured to be removably coupled to the racking board. The racking board has a first end and further includes a first plurality of fasteners located at a first end of the racking board and a racking frame. The diving board includes a second plurality of fasteners, each adapted to removably couple with a corresponding one of the first plurality of fasteners of the racking board.

19 Claims, 11 Drawing Sheets

(56) References Cited

U.S. PATENT DOCUMENTS

| | | | | |
|---|---|---|---|---|
| 10,053,934 | B2 | 8/2018 | Keogh et al. | |
| 11,286,731 | B1 * | 3/2022 | Li | B25J 9/1065 |
| 2004/0057815 | A1 * | 3/2004 | Woolslayer | E21B 19/14 414/22.63 |
| 2010/0303586 | A1 * | 12/2010 | Hankins | E21B 19/14 414/800 |
| 2012/0018222 | A1 * | 1/2012 | Hankins | E21B 19/14 175/57 |
| 2015/0330162 | A1 * | 11/2015 | Magnuson | E21B 19/14 29/434 |
| 2016/0168929 | A1 * | 6/2016 | Magnuson | E21B 19/083 166/379 |
| 2018/0128064 | A1 * | 5/2018 | Gupta | E21B 19/14 |
| 2018/0328112 | A1 * | 11/2018 | Berry | E21B 19/20 |
| 2019/0316421 | A1 * | 10/2019 | Luo | E21B 19/14 |
| 2022/0025715 | A1 | 1/2022 | Saebo et al. | |

* cited by examiner

DETACHABLE DIVING BOARD FOR DRILLING RIG

CROSS-REFERENCES TO RELATED APPLICATIONS

This present application claims the benefit of priority to U.S. provisional patent application Nos. 63/503,900 filed May 23, 2023 titled "Removable Racking Board Systems And Methods"; 63/516,365 filed Jul. 28, 2023 titled "Detachable Diving Board For Drilling Rig"; 63/519,773 filed Aug. 15, 2023 titled "Detachable Diving Board For Drilling Rig"; and 63/516,387 filed Jul. 28, 2023 titled "Methods Of Using A Detachable Diving Board", each of which is hereby incorporated by reference in its entirety for all purposes.

BACKGROUND OF THE DISCLOSURE

There is a demand for improving the efficiency of drilling operations and drilling rig assemblies. Such efficiencies allow wells to be drilled faster, cheaper, and with less impact on the environment. One means of improving drilling efficiency may include increasing the amount of time a drilling rig assembly is actively drilling for oil in a given day, such as by reducing the time required to install a drilling rig and related equipment at a drilling rig site and get everything ready for commencing drilling operations (sometimes referred to as "rigging up"). However, the process of mobilizing a drilling rig assembly (e.g., assembling the rig before drilling begins and taking down the drilling rig assembly once the well has been drilled) may take up a considerable amount of time. Accordingly, a need exists to minimize the drilling rig assembly mobilization time. In addition, in some situations it may be helpful to minimize the size of the pieces of the drilling rig that need to be transported to and from a drilling rig site. In addition, drilling efficiency may be improved by reducing the amount of time a drilling rig is paused from drilling operations due to equipment repairs or changes that may be for example, but not limited to, repairs or changes related to diving boards and/or racking boards.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE DISCLOSURE

Figure 1A:
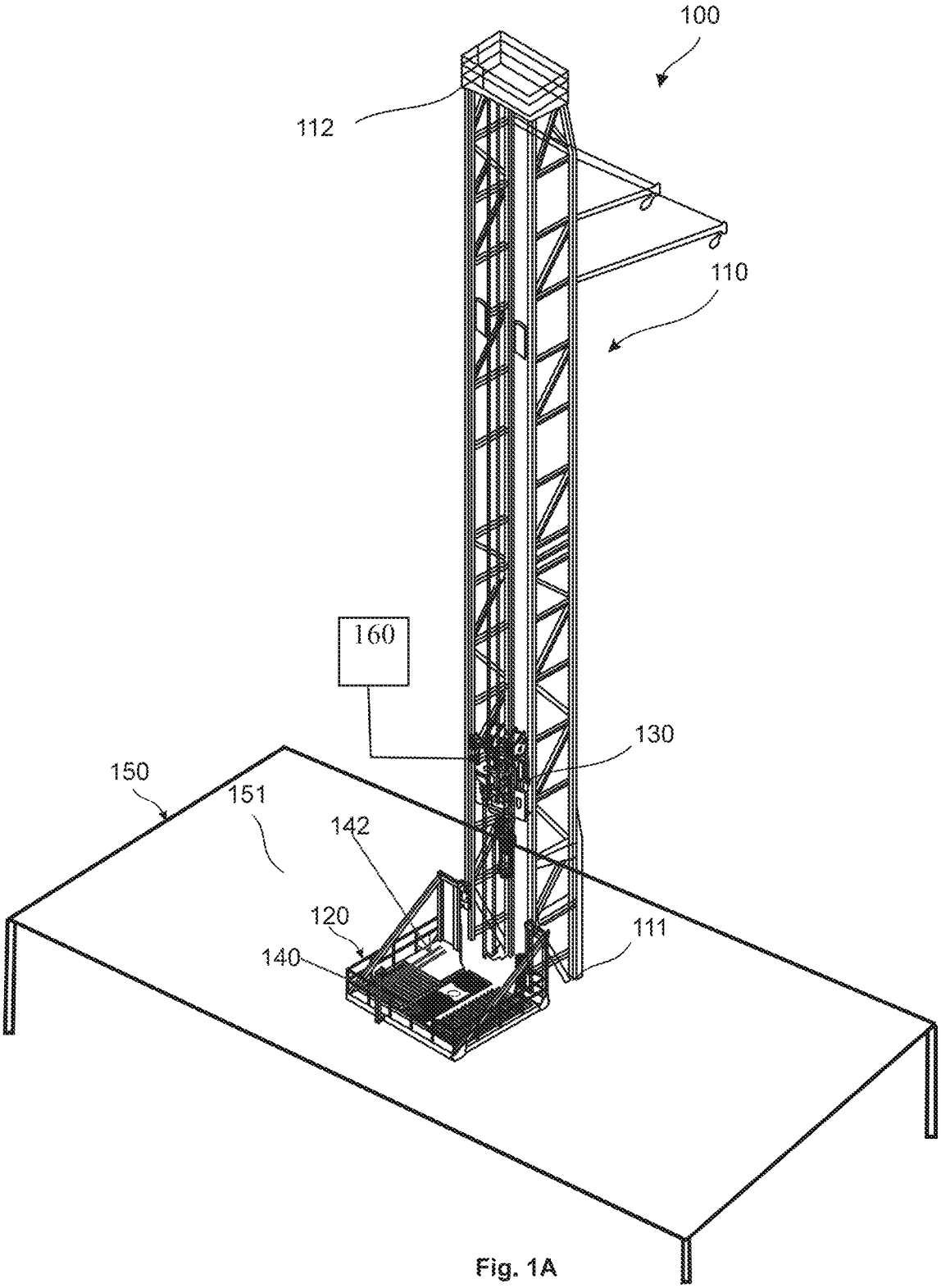
FIG. 1A depicts a drilling rig assembly that includes a racking board coupled to a mast in a lowered position, according to embodiments of the disclosure.

During typical drilling operations, multiple drill pipes are usually coupled together to form stands and the stands are added to a drill string located in the wellbore as drilling occurs. The drill pipes (or stands) may be stored vertically when not being actively utilized. For example, stands may be coupled together and racked before being added to the drill string. In addition, during tripping out, stands removed from the drill string as it is raised out of the wellbore may be racked. By racking the stands (or pipe) close to the wellbore, the time needed to move them to be coupled to the drill string can be minimized, thus allowing the well to be drilled faster.

Typically, a drilling rig includes a racking board coupled to a mast to hold the pipes or stands. However, ensuring that the racking board is set to an appropriate height to hold the pipes may be challenging. For example, where the racking board is coupled to the mast prior to the mast being raised, such as by a fixed connection, the racking board may be fixed in a particular location along the mast once the mast is raised. This may cause an issue where the racking board is not set to an appropriate height to hold the drill pipes or stands. Further, raising the mast with the racking board already coupled to the mast adds additional weight that may cause undue stress on the equipment used to raise the mast, as well as the mast itself. In some cases, additional time to raise the mast may be needed. In some cases, the mast may be damaged during lifting due at least in part to the additional weight of the racking board.

Additionally, during the lifetime of the well, one or more components coupled to the racking board and/or the racking board itself may require repair or replacement. In some examples, a diving board coupled to the racking board may require repair or replacement. In some examples, one or more robotic systems coupled to the racking board may require repair over time. However, taking down the entire mast to access and repair the robotic system on the racking board may reduce the active drilling time of the drilling rig assembly. Different types of robotics systems have been proposed for use with pipe handling and storage operations for drilling and tripping out operations, among others. Examples of such robotics systems are described in WO 2020/160440 to Donnally et al., and U.S. Pat. No. 10,053,934 to Keogh et al., each of which is hereby incorporated by reference as if fully set forth herein. By providing for assemblies and methods for moving a racking board along a length/height of a mast, the downtime of the drilling rig may be reduced.

Further, drilling rig assemblies may drill oil in a wide range of environments. For example, some drilling rig assemblies may be rigged up in an environment subject to large changes in weather (e.g., changing from hot and humid to cold and dry, from raining to snowing, or the like). The drilling rig assemblies in these different weather types may benefit from having different equipment that are more suited for operations in that particular environment. For example, the drilling rig assemblies in a humid, hot environment may include a racking board and/or a diving board that has different textures, coatings, or materials than a racking board and/or a diving board in a cold, dry environment. As such, it would be beneficial to be able to change out the racking boards and/or a diving board to accommodate for differences in weather without taking down the mast each time to reduce drilling tig down time.

The present disclosure may improve drilling rig efficiency and reduce down time by providing for a traveling assembly including a dolly that may raise the racking board to a certain height on the mast after the mast has already been raised. The racking board may be removably coupled to the mast and its traveling assembly after the mast has been raised, and then the racking board may be raised to the specified height above the drilling rig floor. This approach provides greater flexibility, since the racking board can be raised or lowered to one or more heights that may be specified. Thus, the same mast and racking board may be used with the racking board at different heights for drilling different wells or even for drilling different portions of the same well. Moreover, because the racking board is removably coupled to the mast, the mast and racking board may be transported to and from a well site separately, such as on separate skids. In addition, a given racking board might be replaced with a different racking board more easily, such as if the racking board is somehow damaged during drilling operations of a well. Further, raising the racking board after the mast is raised may improve the speed of assembly the drilling rig assembly as the mast may be raised faster without the additional weight of the racking board on the mast. The detachable racking board may be detachable to repair the components coupled to the racking board (e.g., a robotic system) as well as being detachable to accommodate changes in weather without taking down the mast. Accordingly, the detachable racking board may decrease the drilling rig assembly mobilization time and increase the drilling rig assembly active drilling time.

As part of the racking board assembly, a diving board may be included. The diving board may be located in the middle of the racking board and may provide a place for one or more workers to stand while handling the movement and racking of the stands or pipes in the racking board. More recently, the use of pipe handling robotics systems on the diving board has been proposed. The robots can grip, move, rack, and release, the pipes and stands in and out of the racking board, thus avoiding the need for humans to perform such operations and thus minimizing the risk if injuries. However, occasionally such robotics systems have problems. When that happens, especially if the robot ceases to function or cannot be relied upon to properly handle the pipe and stands, the robot will need to be repaired or replaced. Repairing or replacing a robot on a diving board coupled to a racking board of a drilling rig is difficult, and it would be much easier to fix or replace the robot on the ground or even on the drilling rig floor. In addition, in some embodiments, it would be advantageous to allow the diving board to be replaced with one that allows enough space for human operators to handle the pipes, since the robotics systems often take up most of the space on the diving board.

The present disclosure provides for a detachable diving board and methods of removably coupling and decoupling the diving board from the racking board. The detachable diving board may include a robotics system attached thereto, or may be without any robotics systems. If the diving board includes a robotics system, the weight of the diving board when attached to the racking board, may make it harder to lift the mast (if the diving board and racking board combination is attached to the mast), whereas if the diving board may be raised separately after the mast has been raised and after the racking board has been raised, less strain may be placed on the lifting systems. The diving board may in some embodiments be detached from the racking board and returned to the drilling rig floor to repair the robotics system positioned thereon. In some embodiments, the diving board may be detached from the racking board and replaced with a different diving board to accommodate changes in weather without taking down the mast. Providing for separately raising the diving board and/or replacing the diving board without taking down to mast may decrease the active drilling downtime. Accordingly, a detachable racking board, as described herein, may increase the drilling rig assembly active drilling time.

Several illustrative embodiments will now be described with respect to the accompanying drawings, which form a part hereof. The ensuing description provides embodiment(s) only and is not intended to limit the scope, applicability, or configuration of the disclosure. Rather, the ensuing description of the embodiment(s) will provide those skilled in the art with an enabling description for implementing one or more embodiments. It is understood that various changes may be made in the function and arrangement of elements without departing from the spirit and scope of this disclosure. In the following description, for the purposes of explanation, specific details are set forth in order to provide a thorough understanding of certain inventive embodiments. However, it will be apparent that various embodiments may be practiced without these specific details. The figures and description are not intended to be restrictive.

Figure 1B:
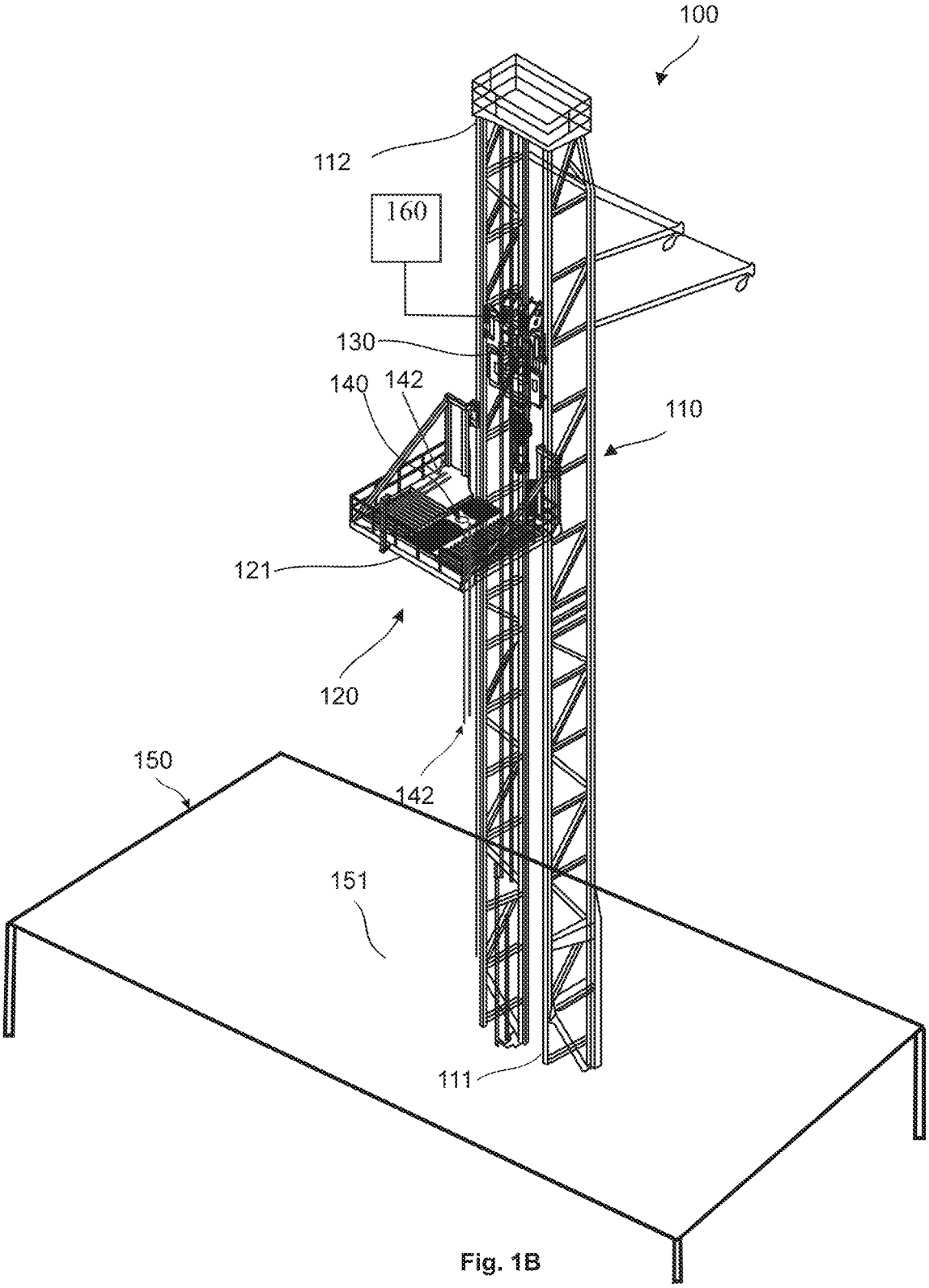
FIG. 1B depicts the drilling rig assembly of FIG. 1A with the racking board coupled with mast, in a raised position.
Figure 1C:
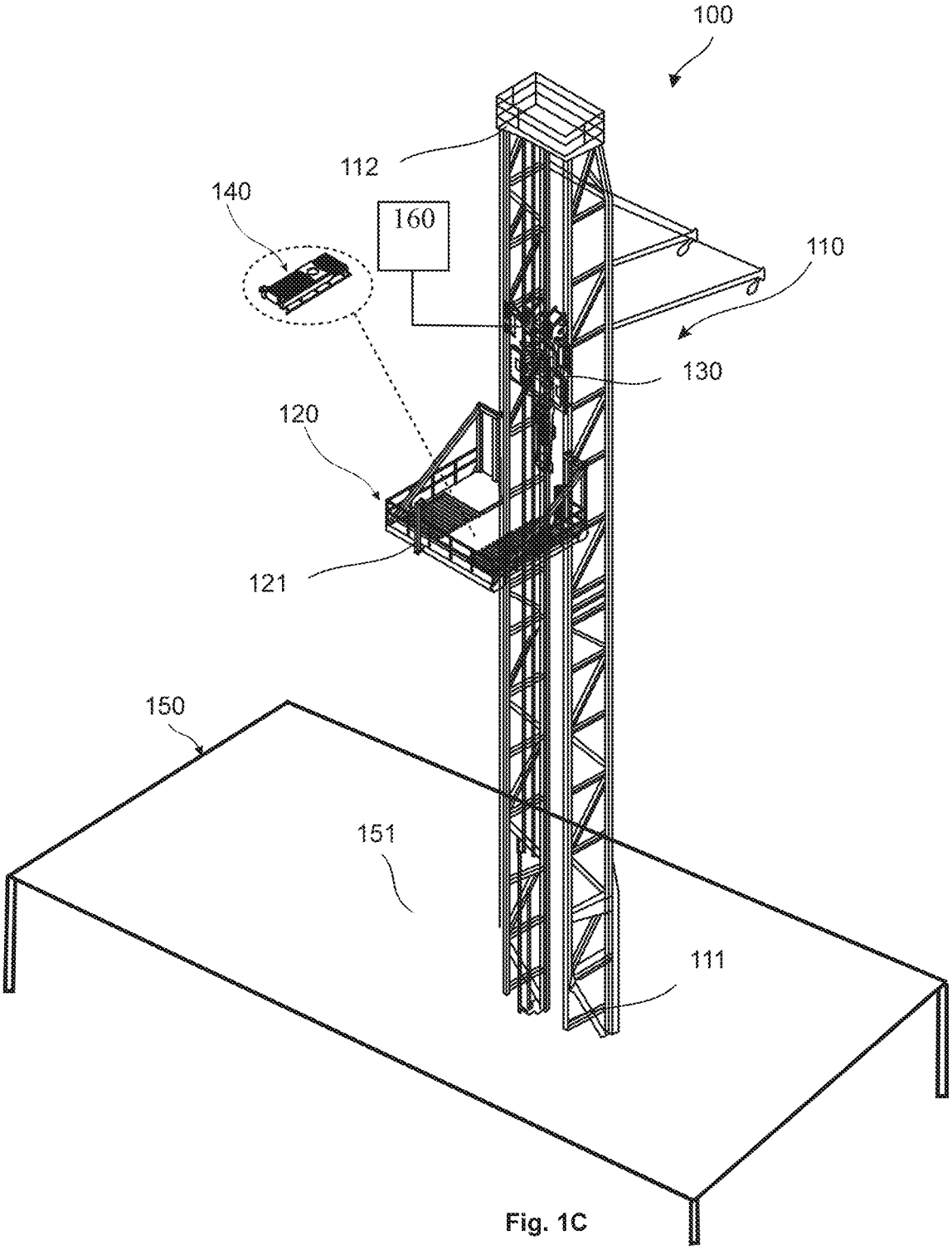
FIG. 1C depicts the drilling rig assembly with a diving board decoupled from the racking board, according to embodiments of the disclosure.

FIGS. 1A-1C depict an example drilling rig assembly 100 including a rig 150 (represented as a box for simplicity), a mast 110, a racking board 120, a traveling assembly 130 coupled to the mast 110, and a rig floor 151 supporting the mast 110. FIG. 1A depicts the racking board 120 in a lowered position, where the racking board 120 is removably coupled to the traveling assembly 130. In some embodiments, the racking board 120 may be removably coupled to one or more tracks (not shown) of the mast 110 before being raised. FIG. 1B depicts the racking board 120 in a raised position, where the racking board 120 is removably coupled to the mast 110 and decoupled from the travelling assembly 130. In some embodiments, the racking board 120 may include a diving board 140. FIGS. 1A-1B depicts the diving board 140 attached to the racking board 120 and FIG. 1C depicts the diving board 140 detached from the racking board 120.

The mast 110 may be a portable structure that can store or couple with one or more drilling rig assembly components. The mast 110 may have a bottom end 111 and a top end 112 that defines a length therebetween. The mast 110 may be rotatably coupled at the bottom end 111 to a substructure (not shown) such that the mast 110 may be rotated along the bottom end 111. As shown, the mast 110 may already be rotated to a raised position by the substructure.

The traveling assembly 130 may be coupled to the mast 110. The traveling assembly 130 may be configured to transport components, including but not limited to the racking board 120, along the length of the mast 110. For example, the traveling assembly 130 may include a top drive, a dolly, sheave assembly, and other equipment that can facilitate transportation of a component up and down the mast 110. A dolly can be an apparatus configured to movably couple to the mast 110 and removably couple to the racking board 120. As an example, referring to FIG. 3, a dolly 300 can comprise a pair of arms 301, 303 each configured to travel up and down existing guide rails on the mast 110 and configured to be removably tethered to the traveling assembly 130. The dolly 300 can have portions of the fastener system attached to a cross beam 302 extending between the two arms 301, 303, with the racking board 120 configured to be removably pined onto the dolly 300 via the fastener systems until the racking board 120 is raised to a specified height. At that point, the racking board 120 can be removably coupled to the mast 110, such as by pinning the racking board 120 to the mast 110. Once secured to the mast 110, the racking board 120 may be decoupled form the dolly 300 and the dolly 300 may be returned to the drilling rig floor 151 where it may be removed until needed again, for example, for rig down. The dolly 300 can be lifted up and down the length of the mast 110 along the rails (not shown) of the mast 110 by the other components of the traveling assembly 130 (e.g., a top drive).

In various embodiments, the drilling rig assembly 100 can include a control system 160 for controlling movement of the travelling assembly 130. The control system 160 can be a computer system including a computer program configured to automatically cease movement of the travelling assembly 130 when the racking board 120 has reached a specified position.

The racking board 120 may be configured to support pieces of the drill pipe 142 or stands of the pipe 142 when the drill pipe 142 is being stored (e.g., prior to being coupled to the drill string or during tripping out operations). For example, the racking board 120 may include a number of fingers to hold one or more drill pipes 142 or stands. In some embodiments, the racking board 120 can store or hold the drill pipes 142 horizontally, and/or vertically, as shown in FIGS. 1A and 1B.

The drilling rig assembly 100 may be transported to a specified location. While being transported, the mast 110 and the racking board 120 may travel separately (i.e., decoupled from each other). When a specified location is reached, the mast 110 may be raised up to a standing position, as shown in FIG. 1A. As the mast 110 is raised up without the additional weight of the racking board 120, the mast 110 may be more quickly raised and with less stress on the components of the substructure that raises the mast 110.

Once the mast 110 is raised, the racking board 120 may be coupled to the traveling assembly 130 at the bottom end 111 of the mast 110. Specifically, the racking board 120 may be coupled to the dolly of the traveling assembly 130. For example, the racking board 120 may be pushed onto the dolly (e.g., 300 in FIG. 3) by one or more humans and/or robotic operator. The racking board 120 may be strapped or otherwise secured to the dolly (e.g., 300) to minimize the relative movement of the dolly (e.g., 300) and the racking board 120 as the dolly (e.g., 300) moves upwards along the mast 110. However, in other embodiments, other means of securing the racking board 120 to the dolly (e.g., 300) may be envisioned, such as clamping the racking board 120 to the dolly (e.g., 300). In this manner, the racking board 120 may be raised up and down the mast 110 as the dolly is raised up and down the mast 110 by the other components of the traveling assembly 130. In some situations, the racking board 120 may be raised without a dolly; the racking board 120 may be coupled to the traveling assembly 130 without the dolly in such situations.

The racking board 120 may be transported by the dolly (e.g., 300) along the length of the mast 110 until a specified height is reached. The specified height may be determined by a human operator and/or automated systems. For example, a human operator on the substructure or on the racking board 120 may determine that the racking board 120 is at an appropriate height based on a visual assessment of the racking board 120 on the mast 110. The human operator may then provide an input to the traveling assembly 130 to halt the movement of the dolly when the human operator visually notes that the dolly (e.g., 300) is at the specified height along the mast 110. Alternatively, the traveling assembly 130 may be configured to automatically detect a desired height (e.g., via a presence sensor) is reached and provide an alert to a human operator when the dolly (e.g., 300) moves to the specified height (e.g., an audible signal, visual signal, tactile signal, or the like). In a yet further alternative embodiment, the dolly (e.g., 300) may automatically stop at a specified height along the mast 110. For example, there may be a stop positioned on the mast 110 that physically prevents the further upward movement of the dolly (e.g., 300) and the racking board 120. In another example, the height may be preset or input in the program that runs the traveling assembly 130 such that the program may automatically instruct the dolly (e.g., 300) to stop at a certain height. In still another example, a computer vision system (e.g., which can be part of the control system 160) may be used to monitor the height of the racking board 120 above the drilling rig floor 151 and control (e.g., via the control system 160) the progress of the racking board 120 and automatically stop the traveling assembly 130 when the racking board 120 has reached a specified height above the drilling rig floor 151.

Turning to FIG. 1B, at this specified height, the racking board 120 may be removed from the dolly (e.g., 300) and removably coupled to the mast 110. For example, the racking board 120 may be unstrapped from the dolly (e.g., 300) and rolled off the dolly (e.g., 300) to decouple the racking board 120 from the dolly (e.g., 300). The racking board 120 may then be pushed toward, and coupled with, with the mast 110. The racking board 120 may be coupled with the mast 110 through any coupling system that secures the racking board 120 to the mast 110. For example, the racking board 120 may be coupled with the mast 110 through a snap-fit engagement. In another example, the racking board 120 may engage the mast 110 through a fastener system (e.g., using one or more bolts, screws, nails, or the like), a clamping system, a pin system (e.g., using one or more pins inserted through the mast 110 and the racking board 120), or other coupling mechanisms without limiting the scope of the present disclosure. Once the racking board 120 is coupled to the mast 110, the dolly (e.g., 300) may be further moved along the mast 110 to transport more equipment.

To return the racking board 120 to the lowered position, the dolly (e.g., 300) may first be transported back to the racking board 120. The racking board 120 may be decoupled from the mast 110 and then coupled with the dolly (e.g., using straps, clamps, or the like). The dolly (e.g., 300), with the racking board 120, may be lowered back down to the bottom end 111 of the mast 110. The racking board 120 may then be decoupled with the dolly (e.g., unstrapped and pushed off the dolly).

Referring to FIGS. 1B and 1C, the diving board 120 can include a body having a first end and a second end. The first end of the diving board can include a first coupling mechanism (e.g., slots or openings) and a second coupling mechanism (e.g., slots or openings). The first coupling mechanism can be adapted to removably couple with a first coupling mechanism (e.g., bars or pins) of a racking board at a corresponding first end of the racking board. Examples of coupling mechanisms are discussed in various embodiments below, however the present disclosure is not limited to a particular coupling mechanism to removably couple the diving board 140 to the racking board 120.

As illustrated in FIGS. 1B and 1C, the racking board 120 may include a racking frame 121 and the diving board 140 coupled to the racking frame 121. In some embodiments, the racking frame 121 may be configured to support pieces of the drill pipe 142 or stands of the pipe 142 when the drill pipe is being stored (e.g., prior to being coupled to the drill string or during tripping out operations). For example, the racking frame 121 may include a number of fingers to hold one or more drill pipes 142 or stands. The diving board 140 and the racking board 120 may be made of stainless steel or other rigid materials.

The diving board 140 may be detachably coupled to the racking frame 121 through a fastener system (e.g., using one or more bolts, screws, nails, or the like), a clamping system, a pin system (e.g., using one or more pins inserted through the racking frame 121 and the diving board 140), or the like. The diving board 140 may be detachable from the racking frame 121. For example, where the diving board 140 is coupled with the racking frame 121 with a pin system (not shown), the diving board 140 may be detached from the racking frame 121 by decoupling the pins of the pin system from the diving board 140 and the racking frame 121.

Turning specifically to FIG. 1C, the mast 110 may be raised and the racking board 120 can be coupled to the mast 110 (as discussed earlier) without the diving board 140 coupled to the racking frame 121. As the mast 110 is raised up without the additional weight of the diving board 140, the mast 110 may be more quickly raised and with less stress on the components of the substructure that raises the mast 110.

Once the mast 110 is raised, the dolly (e.g. 300 in FIG. 3) of the traveling assembly 130 may be lowered to the bottom end 111 of the mast 110 (if the dolly is not already at the bottom end 111 of the mast 110). The diving board 140 may be coupled to the traveling assembly 130 at the bottom end 111 of the mast 110. Specifically, the diving board 140 may be coupled to the dolly (e.g., 300) of the traveling assembly 130. For example, the diving board 140 may be pushed onto the dolly (e.g., 300) by one or more humans and/or robotic operator. The diving board 140 may be strapped to the dolly (e.g., 300) to minimize the relative movement of the dolly (e.g., 300) and the diving board 140 as the dolly moves upward along the mast 110. However, in other embodiments, other means of securing the racking board 120 to the dolly (e.g., 300) may be envisioned, such as clamping the diving board to the dolly (e.g., 300). In this manner, the diving board 140 may be raised up and down the mast 110 as the dolly (e.g., 300) is raised up and down the mast 110 by the other components of the traveling assembly 130. In some situations, the diving board 140 may be raised without a dolly; the diving board 140 may be coupled to the traveling assembly 130 without the dolly in such situations.

The diving board 140 may be transported by the dolly (e.g., 300) along the mast 110 until the dolly arrives at the racking board 120. A human operator may determine that the dolly (e.g., 300) and the diving board 140 has arrived at the racking board 120. For example, a human operator on the substructure, on the racking board 120, or on the diving board 140 may determine that the diving board 140 is at the appropriate location (e.g., the dolly may be substantially coplanar with the floor of the racking frame 121) based on a visual assessment of the diving board 140 on the mast 110. The human operator may then provide an input to the traveling assembly 130 to halt the movement of the dolly (e.g., 300) when the human operator visually notes that the dolly (e.g., 300) is at the racking board 120. Alternatively, the traveling assembly 130 may be configured to automatically provide an alert to a human operator when the dolly (e.g., 300) arrives at the racking board 120 (e.g., an audible signal, visual signal, tactile signal, or the like). In a yet further alternative embodiment, the dolly (e.g., 300) may automatically stop at the racking board 120. For example, there may be a stop positioned adjacent the racking board 120 that physically prevents the further upward movement of the dolly (e.g., 300) and the diving board 140. In another example, the position of the racking board 120 may be preset or input in the program that runs the traveling assembly 130 such that the program may automatically instruct the dolly to stop when the dolly reaches the racking board 120. In still another example, a computer vision system may be used to monitor the height of the diving board 140 above the drilling rig floor 151 and control (e.g., via the control system 160) the progress of the racking board 120 and automatically stop the traveling assembly 130 when the diving board 140 has reached a specified height above the drilling rig floor 151 (e.g., adjacent the racking board 120).

Turning to FIG. 1C, when the dolly (e.g., 300) is positioned adjacent the racking board 120, the diving board 140 may be removably coupled to the racking board frame 121 and then from the dolly. For example, the diving board 140 may be pushed toward, and coupled with, the racking frame 121. The diving board 140 may be unstrapped from the dolly (e.g., 300) and rolled off the dolly (e.g., 300) to decouple the diving board 140 from the dolly (e.g., 300). The diving board 140 may be removably coupled with the racking frame 121 through any coupling system that secures the diving board 140 to the racking frame 121. For example, the diving board 140 may be coupled with the racking frame 121 through a snap-fit engagement. In another example, the diving board 140 may engage the racking frame 121 through a fastener system (e.g., using one or more bolts, screws, nails, or the like), a clamping system, a pin system, or the like. The present disclosure is not limited to particular fastener system. Once the diving board 140 is coupled to the racking frame 121, the dolly (e.g., 300) may be further moved along the mast 110 to transport more equipment.

To return the diving board 140 to the lowered position (e.g., when one or more components on the diving board 140 are damaged, such as robots positioned on the dolly), the dolly (e.g., 300) may first be transported back to the racking board 120. The diving board 140 may be coupled to the dolly (e.g., 300) (or the traveling assembly 130) and then decoupled from the racking frame 121. The dolly (e.g., 300), with the diving board 140, may be lowered back down to the bottom end 111 of the mast 110. The diving board 140 may then be decoupled with the dolly (e.g., unstrapped and unloaded from the dolly (e.g., 300)). The damaged components on the diving board 140 may either be replaced or fixed, and the diving board 140 may be transported back to the racking board 120 as discussed above.

Figure 2A:
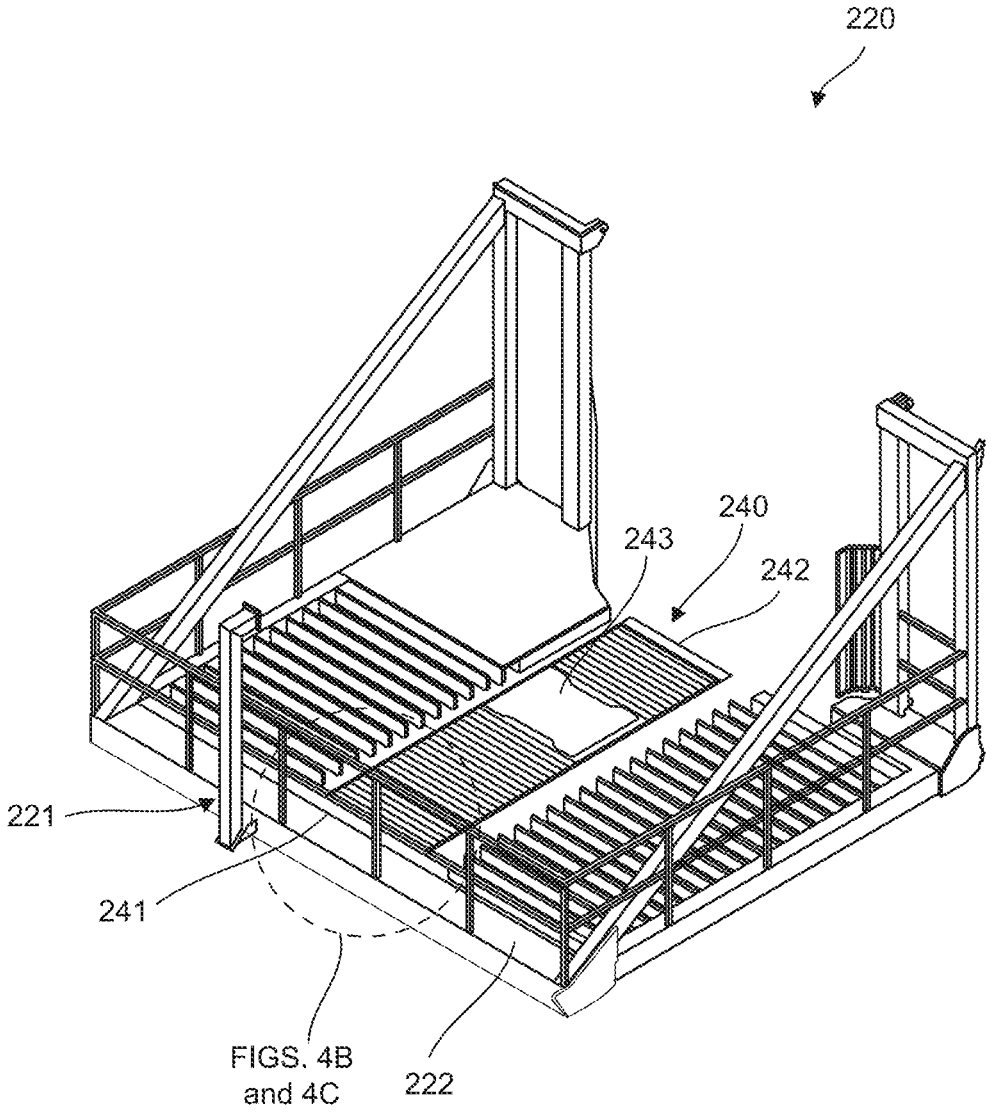
FIG. 2A depicts a racking board with a diving board coupled thereto according to embodiments of the disclosure.
Figure 2B:
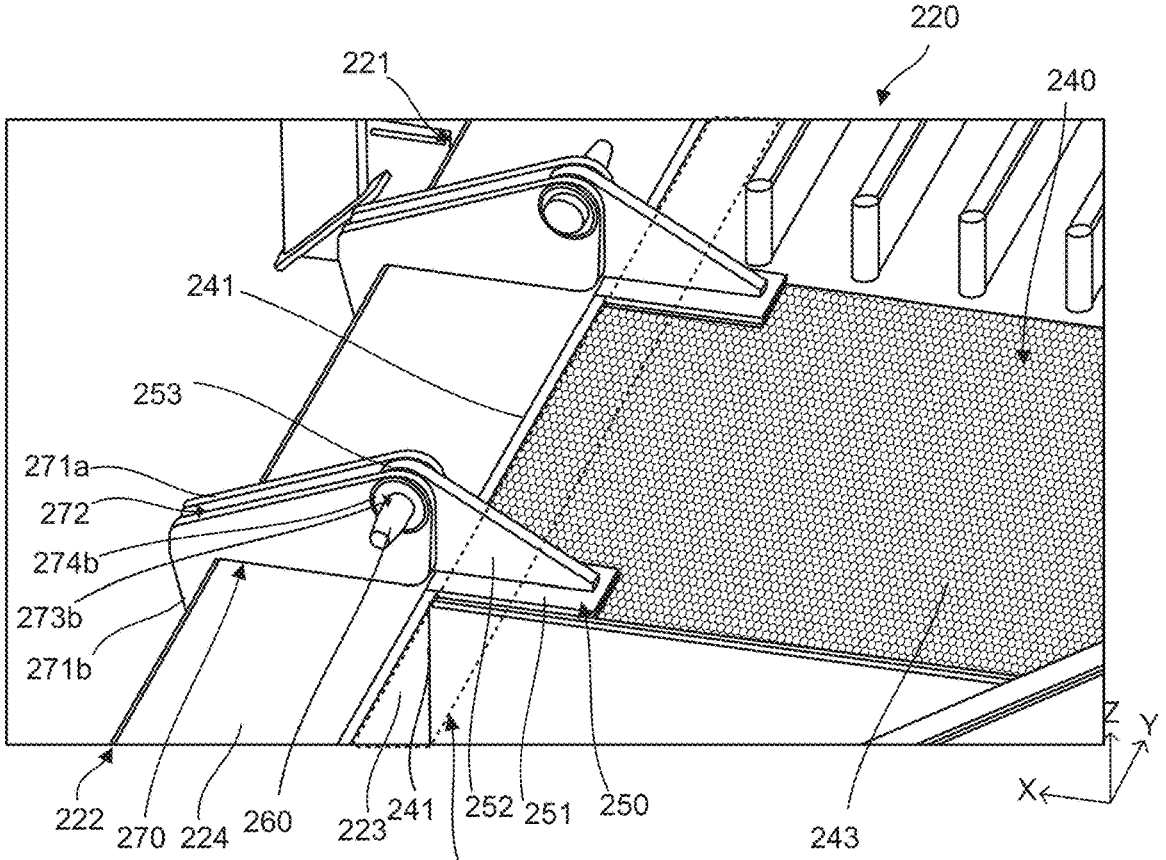
FIG. 2B depicts a partial view of the coupling between the diving board and a portion of the racking board of FIG. 2A.
Figure 2C:
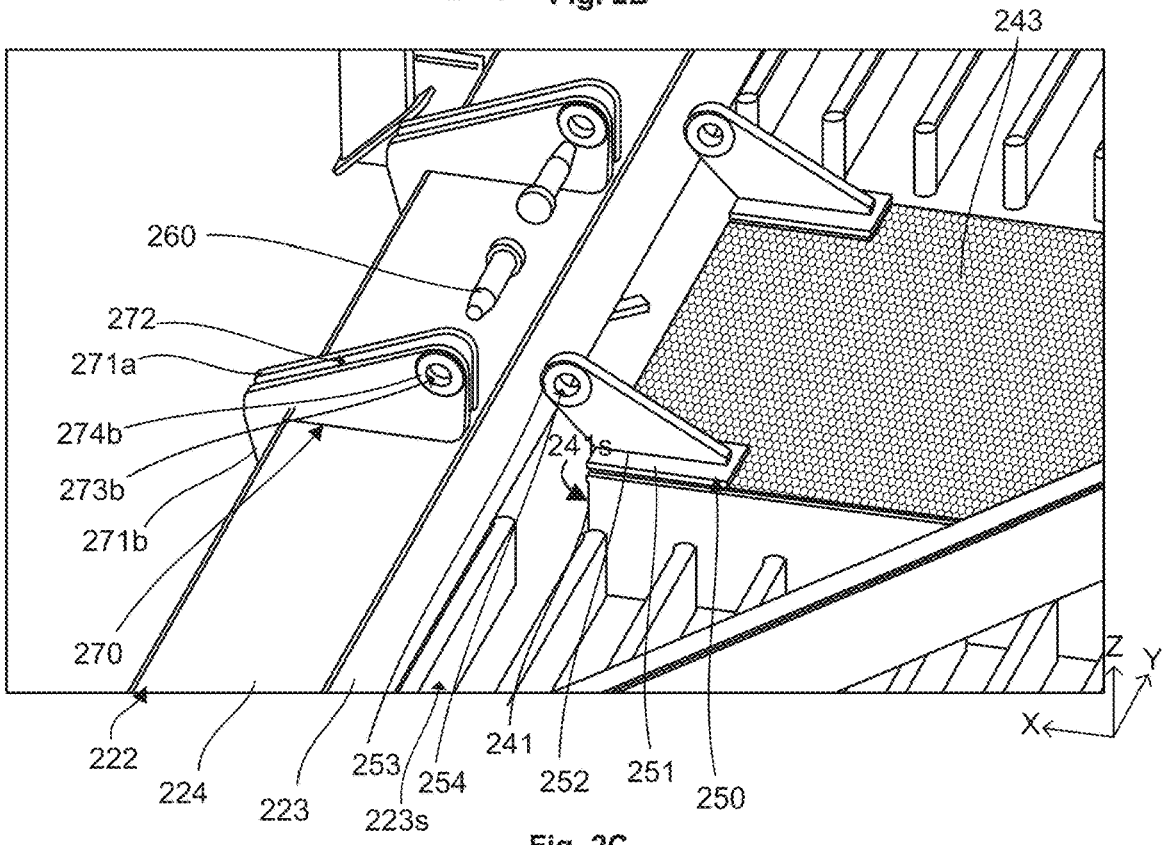
FIG. 2C depicts a partial view of the diving board and a portion of the racking board of FIG. 2A detached from each other.

FIGS. 2A-2C depict an example racking board 220, which can be an example of the racking board 120 discussed herein. It is understood that features with two ending digits having like reference numerals as features discussed above are similar, except as noted below. The racking board 220 can include a racking frame 221 configured to couple with the diving board 240. The driving board 240 may include an end (e.g., 241) configured to couple with the racking frame 221. For example, the racking frame 221 can include a first surface (e.g., 223*s*) proximal a first end (e.g., 223), and the first end (e.g., 241) of the diving board 240 defines a surface (e.g., 241*s*) adapted to rest against the first surface (e.g., 223*s*) of the racking frame 221.

In the illustrated embodiment, the racking frame 221 (which can be an example of the racking frame 121) may include a strut 222. The strut 222 may be substantially cuboid in shape (e.g., having a rectangular cross-section), however, in other embodiments, the strut may have any other shape. The diving board 240 (which can be an example of the diving board 140) may include a diving board body 243 having a first body end 241 and a second body end 242. The diving board body 243 may be a top surface configured to allow for human or robotic operators to be positioned thereon. As shown in FIG. 2B, the first body end 241 of the diving board 240 may abut against the strut 222 when the diving board 240 is coupled to the racking frame 221. Specifically, the diving board 240 may include protrusions 250 extending from the diving board body 243 that are coupled to strut receptacles 270 extending from the strut 222 with a fastener 260.

The protrusions 250 may include a base 251 and a protrusion body 252 extending from the base 251. The base 251 may be substantially shaped as a rectangular prism (e.g., having a rectangular cross-section), however, in other embodiments, the base may have any other shape. The protrusion body 252 may have a plate structure having a protrusion end 253. The protrusion end 253 may be curved, however, in other embodiments, the protrusion end may have any other shape, such as angled, flat, or some other shape. The protrusion body 252 may extend from the base 251 at an upward angle along the X-Z plane extending past the end 241 such that the protrusion end 253 may be received in the strut receptacle 270. However, in other embodiments, the protrusion end does not extend past the first body end adjacent the strut and, instead, the strut receptacle extends past the first body end in an X-direction towards the protrusion to couple with the protrusion.

As discussed below, the protrusion end 253 may have a thickness to be received in the strut receptacle 270 and may define a protrusion aperture 254 to be aligned with a portion of the strut receptacle 270. The protrusion aperture 254 may be sized and shaped to receive the fastener 260. The protrusion end 253 may have a thickness larger than the protrusion body 252, however, in other embodiments, the protrusion body and the protrusion end may have a similar thickness.

The strut 222 may include a strut surface 224 extending along an X-Y plane and a strut sidewall 223 extending in a Z-direction from the strut surface 224 along a Y-Z plane. The strut receptacles 270 extend from the strut surface 224 upwards along a Z-direction. The strut receptacles 270 may include strut walls 271*a*, 271*b* defining a channel 272 therebetween. The channel 272 may have a width corresponding to a thickness of the protrusion end 253. The strut walls 271*a*, 271*b* may each have a plate structure. The strut wall 271*b* may have a strut wall end 274*b* and the strut wall 271*a* may have a strut wall end (not shown) similar to the strut wall end 274*b* (collectively, the "pair of strut wall ends"). The pair of strut wall ends may be cylindrical, however, in other embodiments, may have any other shape, such as cuboid or the like. The pair of strut wall ends may have a thickness larger than the strut walls 271*a*, 271*b*, however, in other embodiments, the pair of strut wall ends and the strut walls may have a similar thickness. The increased thicknesses of the pair of strut wall ends and the protrusion end 253 may provide increased structural rigidity when the protrusions 250 and the strut receptacles 270 are coupled to each other.

The strut wall end 274*b* may define a strut aperture 273*b* and the strut wall end of the strut wall 271*a* may define a corresponding strut aperture (not shown) similar to the strut aperture 273*b* (collectively, the "pair of strut apertures"). The pair of strut apertures may be sized and shaped to removably receive the fastener 260 therein. Further, the pair of strut apertures may be concentrically aligned along the Y-axis such that the fastener 260 may be inserted through both the pair of strut apertures. In some embodiments, each of the strut receptacles may only include one strut wall to couple with the protrusion of the diving board.

As shown in FIG. 2B, the diving board 240 and the racking frame 221 may be coupled together when the protrusion end 253 is received within the channel 272 between the strut walls 271*a*, 271*b* and the protrusion aperture 254 are aligned with the pair of strut apertures. The fastener 260 may be inserted along a Y-direction through the protrusion aperture 254 and the pair of strut apertures to removably couple the diving board 240 and the racking frame 221 together. In this configuration, the diving board 240 may be fixed in place along the X-Y plane relative to the strut 222 but rotatable about a Y-about the fasteners 260. The clockwise rotation about the Y-axis of the diving board 240 may be limited by the contact between the body end 241 of the diving board 240 and the sidewall 223 of the strut 222. Accordingly, the diving board 240 may be held in place at a resting position by the weight of the diving board 240 pushing against the sidewall 223.

Turning to FIG. 2C, the diving board 240 may be detached from the racking frame 221 by removing the fasteners 260 from the protrusion aperture 254 and the pair of strut apertures along a Y-direction. Doing so may allow for the diving board 240 to be translated away from the strut 222 along the X-Z plane. As noted above, detaching the diving board 240 may be useful where one or more components of the diving board 240 may require repair or replacement. The diving board 240 may be detached to repair or replace those components and then re-attached later on, thus minimizing the oil drilling downtime.

Figure 4A:
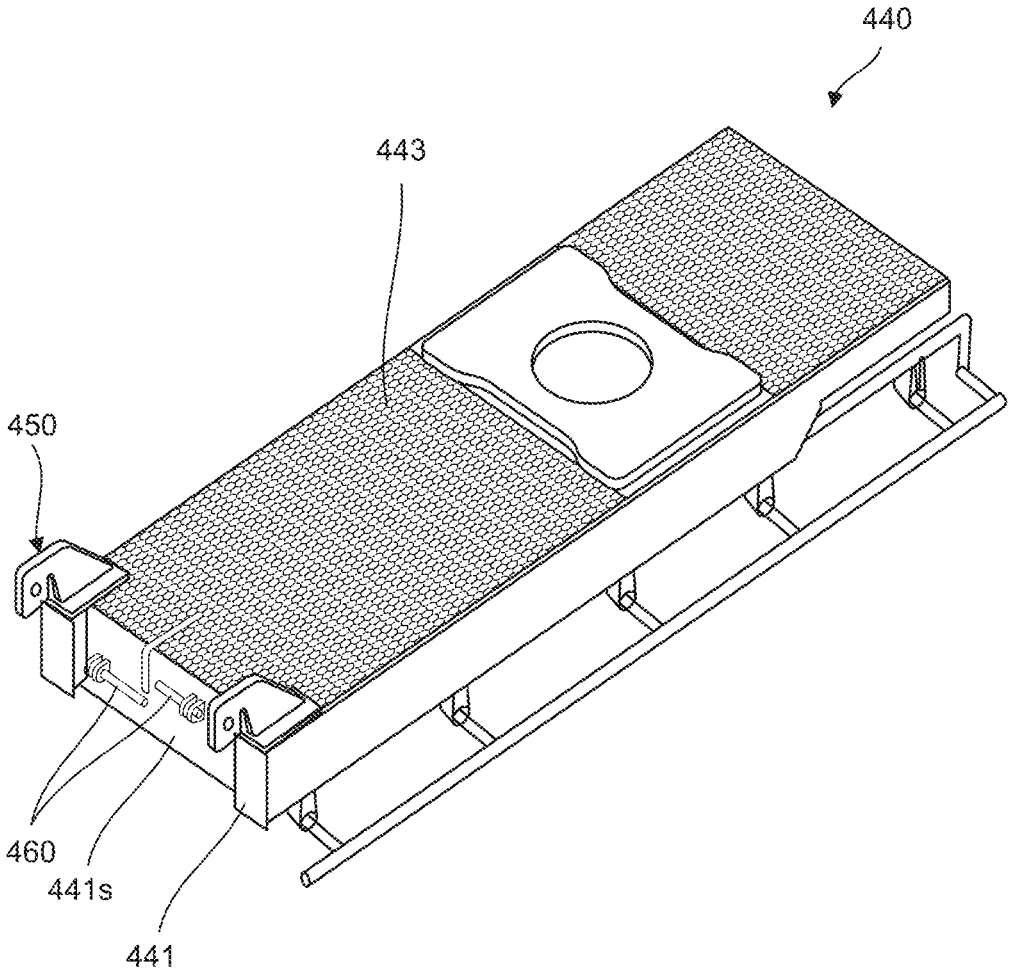
FIG. 4A depicts an isometric view of a diving board according to embodiments of the disclosure.
Figure 4B:
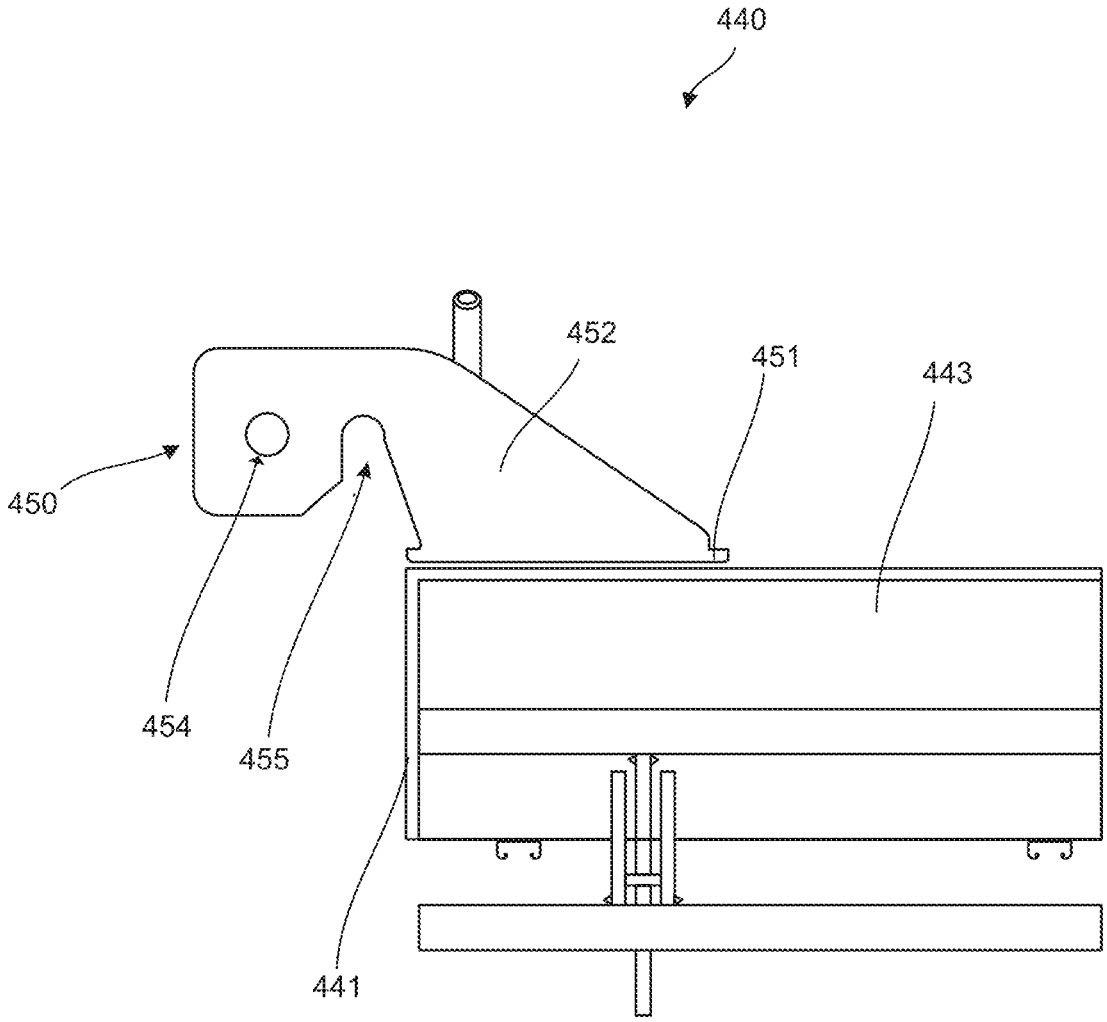
FIG. 4B depicts a side view of the diving board of FIG. 4A.

The diving board may have other coupling means to attach the diving board to the racking board. FIGS. 4A-4B depicts another example diving board 440 (which can be another example of the diving board 140). It is understood that features ending two digits having like reference numerals as features discussed above are similar, except as noted below. Referring to FIG. 4A, the diving board 440 includes a diving board body 443 having a first body end 441 with a first surface 441*s* configured to couple to the racking board 440. For example, a pair of hooks 450 can extend from the diving board body 443. The hooks 450 each include a base 451 and a hook body 452 extending from the base 451. The hook body 452 defines a slot 455 and an aperture 454 to removably receive other components, as described further below. The hook body 452 may extend past the body end 441 such that the slot 455 and aperture 454 may engage with other components a distance from the diving board body 443. The diving board 440 may include a pair of pins 460 that are configured to couple with other components, such as the apertures 454. In FIG. 4B, one of the hooks 450, including the base 451, the hook body 452, the aperture 454, and the slot 455, are shown in greater detail.

Figure 5:
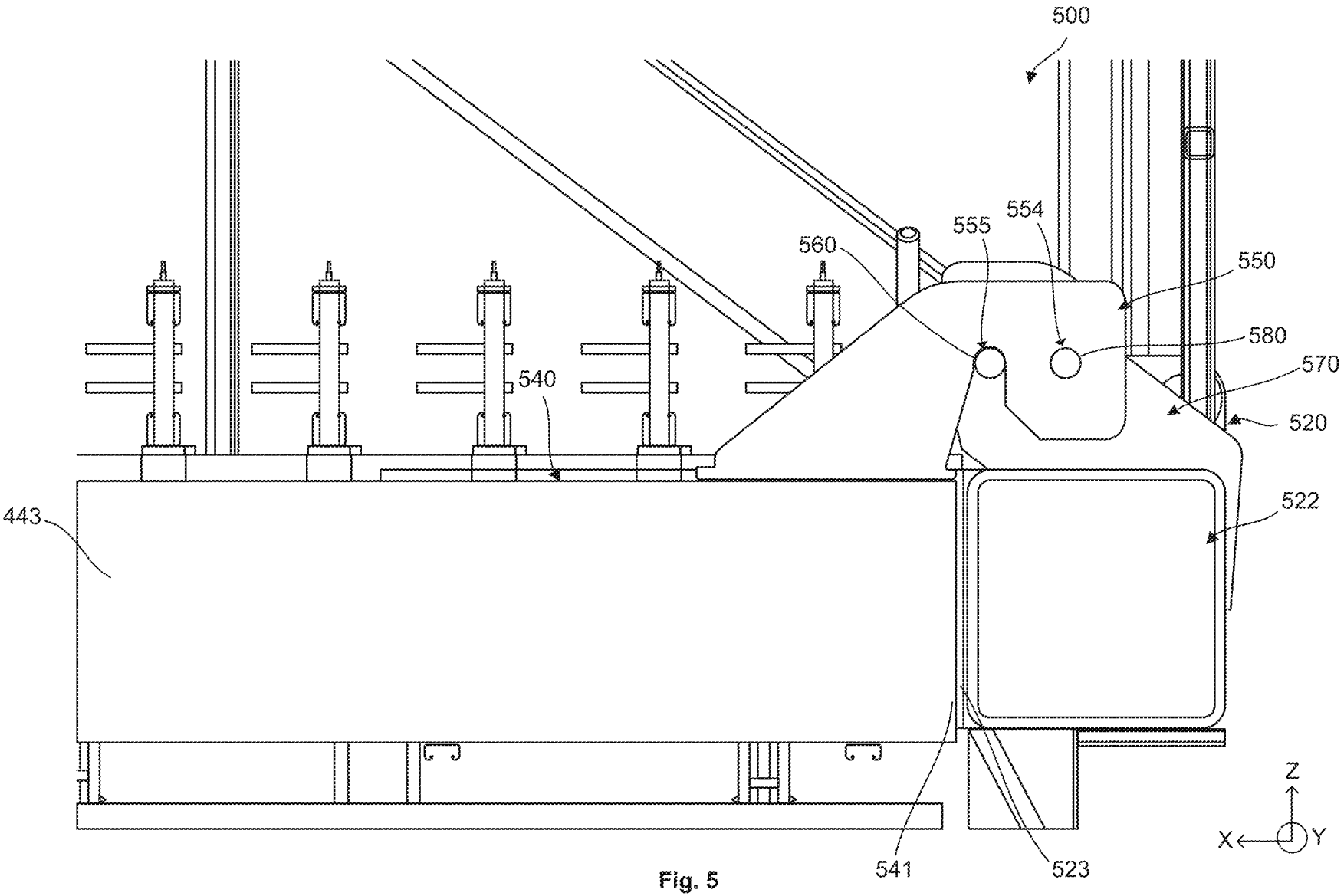
FIG. 5 depicts a side view of a drilling rig assembly according to embodiments of the disclosure.

FIG. 5 depicts an example of a portion of a drilling rig assembly 500 with a diving board 540 coupled to a racking board 520. It is understood that features ending in like reference numerals as features discussed above are similar, except as noted below. The racking board 520 may include a strut protrusion 570 extending from the strut 570 in a Z-direction. The racking board 520 may include a bar 560 extending from the strut protrusion 570 in a Y-direction. The bar 560 may have a size and length sufficient to be received in the slot 555 of the diving board 540 when the racking board 520 is coupled with the diving board 540, as discussed further below. It should be noted that the bar 560 and slot 555 may be sized and shaped so that the racking board 520 and diving board 540 can be removably and securely coupled to one another, yet can be decouple relatively easily when decoupling is desired.

The diving board 540 may be coupled to the racking board by receiving the bar 560 within the slot 555 and by inserting the pin 580 in the aperture 554. Prior to the pin 580 being inserted within the aperture 554, the diving board 540 may be rotatable about the bar 560. The rotation of the diving board 540 about the bar 560 may be limited by the abutment of the body end 541 of the diving board 540 against the sidewall 523 of the racking board 520.

As will be discussed further below, the pin 580 may be inserted within the aperture 554 to lock the diving board 540 to the racking board 520. In some embodiments, the pin received in the aperture may be a fastener. In some embodiments, the strut protrusion 570 may include a corresponding aperture (not shown) concentric with the aperture 554 to receive the pin 580 such that the pin 580 prevents the relative translation of the diving board 540 to the racking board 520. In some embodiments, there may be a single pin 580 extending through both of the apertures 554 of each of the hooks 550, however, in other embodiments, there may be a corresponding pin for the aperture of each hook to couple the diving board to the racking board. In some embodiments, the racking board may have one or more permanent bars 560 adapted to fit into one of the slots 555 of the diving board 440. In addition, the diving board 440 and/or the racking board 520 may have one or more guide members that are adapted to help guide and align the placement of the racking board's bars within the slots 555 of the diving board. The one or more pins 460, 580 may be located so that they can be extended from a first position (not extended) to a second position (extended) in which the pins 460, 580 extend into the corresponding openings 454, 554 and thereby lock the diving board and rocking board together. In some embodiments, the pins 460, 580, may be automatically and/or remotely actuated to move between the first and second positions.

Figure 6:
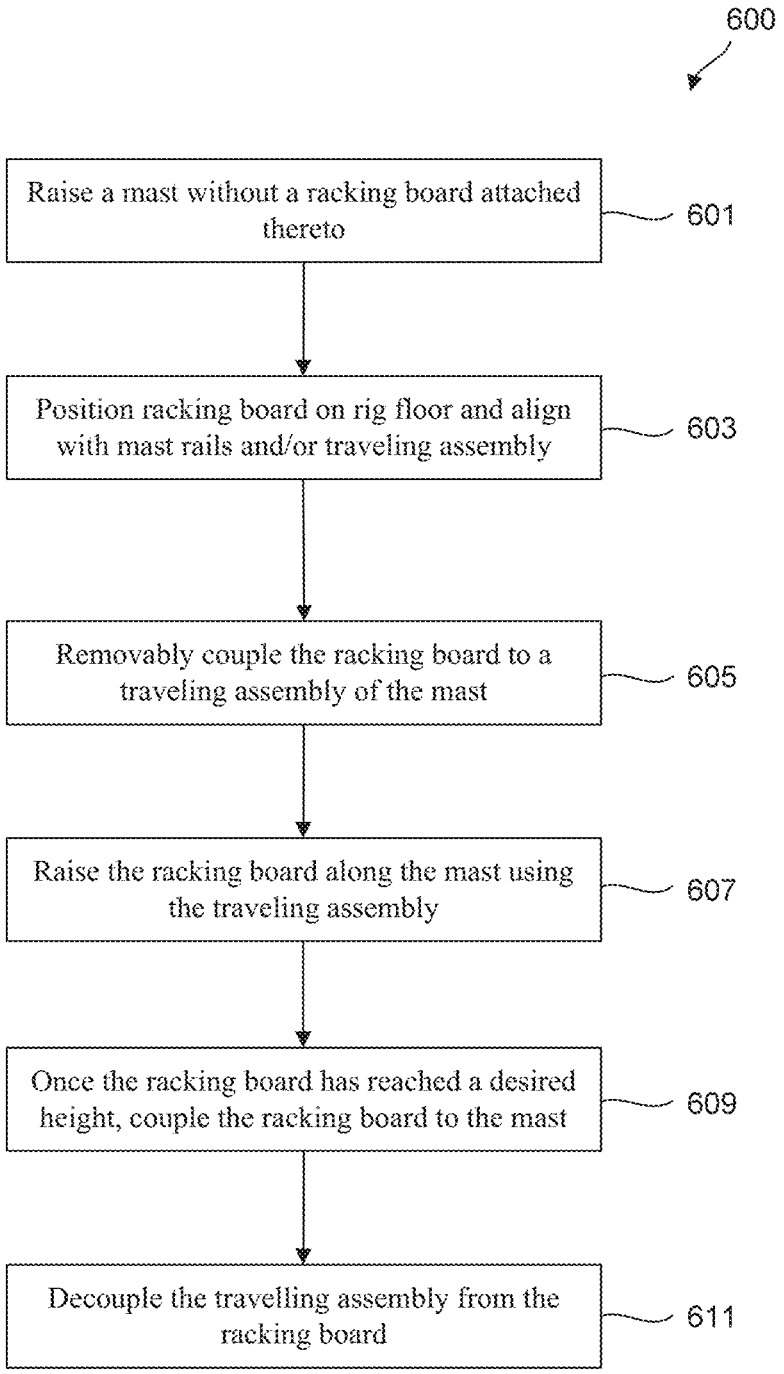
FIG. 6 depicts a non-limiting exemplary method of using a racking board, according to embodiments of the present disclosure.

FIG. 6 depicts an example flowchart 600 depicting a non-limiting exemplary method of using a racking board according to embodiment of the present disclosure, including but not limited to the racking board 120 of FIGS. 1A and 1B. In one example, a mast (e.g., the mast 110 in FIGS. 1A and 1B) may be raised to a standing position without the racking board (e.g., 120) coupled to the mast (e.g., 110).

At step 601, the mast (e.g., 110) is raised without the detachable racking board (e.g., 120). Next, at step 603, the racking board (e.g., 120) may be placed on the drilling rig floor and positioned so that it is aligned for lifting. The racking board (e.g., 120) may be aligned with a travelling assembly (for example traveling assembly 130), the dolly (e.g., 300), and/or the mast rails as previously described. With specific reference to step 605, the racking board (e.g., 120) may be coupled to the travelling assembly (e.g., 130), such as by removably coupling the racking board (e.g., 120) to the dolly (e.g., 300) of the traveling assembly (e.g., 130). The racking board (e.g., 120) may be coupled to the dolly of the traveling assembly (e.g., 130) with a fastener system, a clamping system, a pin system, or other coupling mechanisms. For example, the racking board (e.g., 120) may be coupled to the dolly with a fastener inserted through a portion of the racking board (e.g., 120) and the dolly (e.g., 300).

With specific reference to step 607, the racking board (e.g., 120) may be transported upward along the mast (e.g., 110) by the dolly (e.g., 300) and the travelling assembly (e.g., 130) toward a specified location along the mast (e.g., 110). Once the dolly (e.g., 300) has reached the specified location, the traveling assembly (e.g., 130) may be configured to automatically provide an alert signaling that the dolly (e.g., 300) has reached the specified location. The dolly (e.g., 300) may stop (e.g., automatically or manually) once the racking board (e.g., 120) has reached this specified location. The racking board (e.g., 120) may be decoupled from the dolly (e.g., by removing the fastener inserted through the dolly (e.g., 300) and the racking board 120). The racking board (e.g., 120) may then be positioned in the specified location along the mast (e.g., 110).

With specific reference to step 609, the racking board (e.g., 120) may be removably coupled to the mast (e.g., 110) with a fastener system, a clamping system, a pin system, or the like. At 611, the travelling assembly and/or dolly may be decoupled from the racking board. Should the racking board (e.g., 120) be detached again (e.g., to repair or replace one or more components coupled to the racking board (e.g., 120) or change the racking board (e.g., 120) to an alternative racking board), the racking board (e.g., 120) may be decoupled from the mast (e.g., 110) and coupled to the traveling assembly (e.g., 130) to be lowered (and/or replaced with a different racking board) repeating the steps noted above.

Once in a specified first position, the detachable racking board (e.g., 120) can be moved to a second position (or third or fourth, etc.) if desired. The mast may have a plurality of fastener systems (such as any one or more of those noted above) located at different heights or different positions on the mast (e.g., 110). When a move is desired, the racking board (e.g., 120) can be coupled to the travelling assembly (e.g., 130) (which may include the dolly (e.g., 300)), then decoupled from the mast (e.g., 110), then moved from the first position to a specified second position (which may be higher or lower than the first position), then coupled to the mast (e.g., 110) at the second position, such as with any one or more of the fastener systems noted above, at which point the racking board (e.g., 120) may be decoupled from the travelling assembly (e.g., 130).

Figure 7:
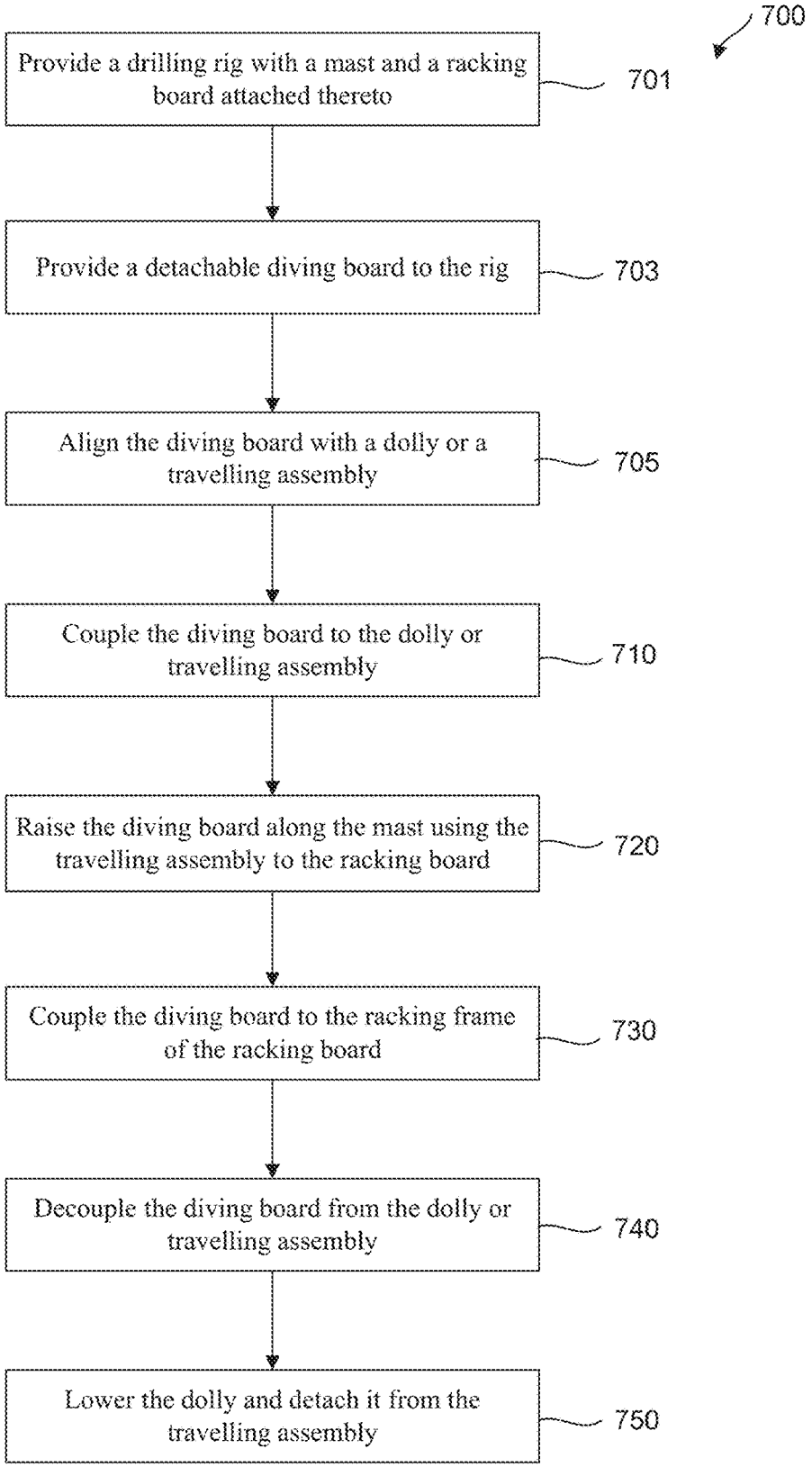
FIG. 7 depicts another non-limiting exemplary method of raising and coupling the detachable diving board to a racking board, according to embodiments of the present disclosure.

In some embodiments, the method 600 can further include rhe rwith the travelling assembly (e.g., 130) or the dolly (e.g., 140) of the travelling assembly. The steps of lowering can be similar to that of raising the racking board as discussed herein, but in reverse. For example, the racking board (e.g., 120) can be lowered to the rig floor 151 by driving a top drive to lower the travelling assembly (e.g., 130) or the dolly (e.g., 140) of the travelling assembly. The lowered racking board can be decoupled from the travelling assembly (e.g., 130). Further, (e.g., 130) the lowered racking board (e.g., 120) can be repaired and coupled to the travelling assembly. Then, FIG. 7 depicts an example flowchart 700 depicting a non-limiting exemplary method of removably coupling a diving board according to embodiment of the present disclosure. In some embodiments, the diving board 140 of FIGS. 1A-1C, the diving board 240 of FIGS. 2A-2C or the diving board 340, 440 of FIGS. 4A, 4B, and 5 can be removably coupled to a racking board. In one example, a mast (e.g., the mast 110, shown in FIGS. 1B and 1C) may be raised to a standing position with the racking board (e.g., 120 in FIGS. 1B and 1C, or 220 in FIGS. 2A-2C) coupled to the mast but without the diving board (e.g., 240). Accordingly, the diving board (e.g., 240) may be transported to couple to the racking frame (e.g., 221). The diving board (e.g., 240) may include one or more of a human operator, robotic system, and/or features designed for use in the weather and environment of the drilling rig assembly. Referring to FIG. 7, the method of raising and coupling the detachable diving board (e.g., 240) begins at step 701 when the mast of a drilling rig has been raised and a suitable racking board with a racking frame adapted for removably coupling with the diving board has been raised and attached (fixedly or removably) to the mast. Next, at step 703, a detachable diving board such as described above is provided at the drilling site. In step 705, the detachable diving board is placed in a position where it is aligned with a dolly attached to a traveling assembly or to the traveling assembly itself.

Figure 3:
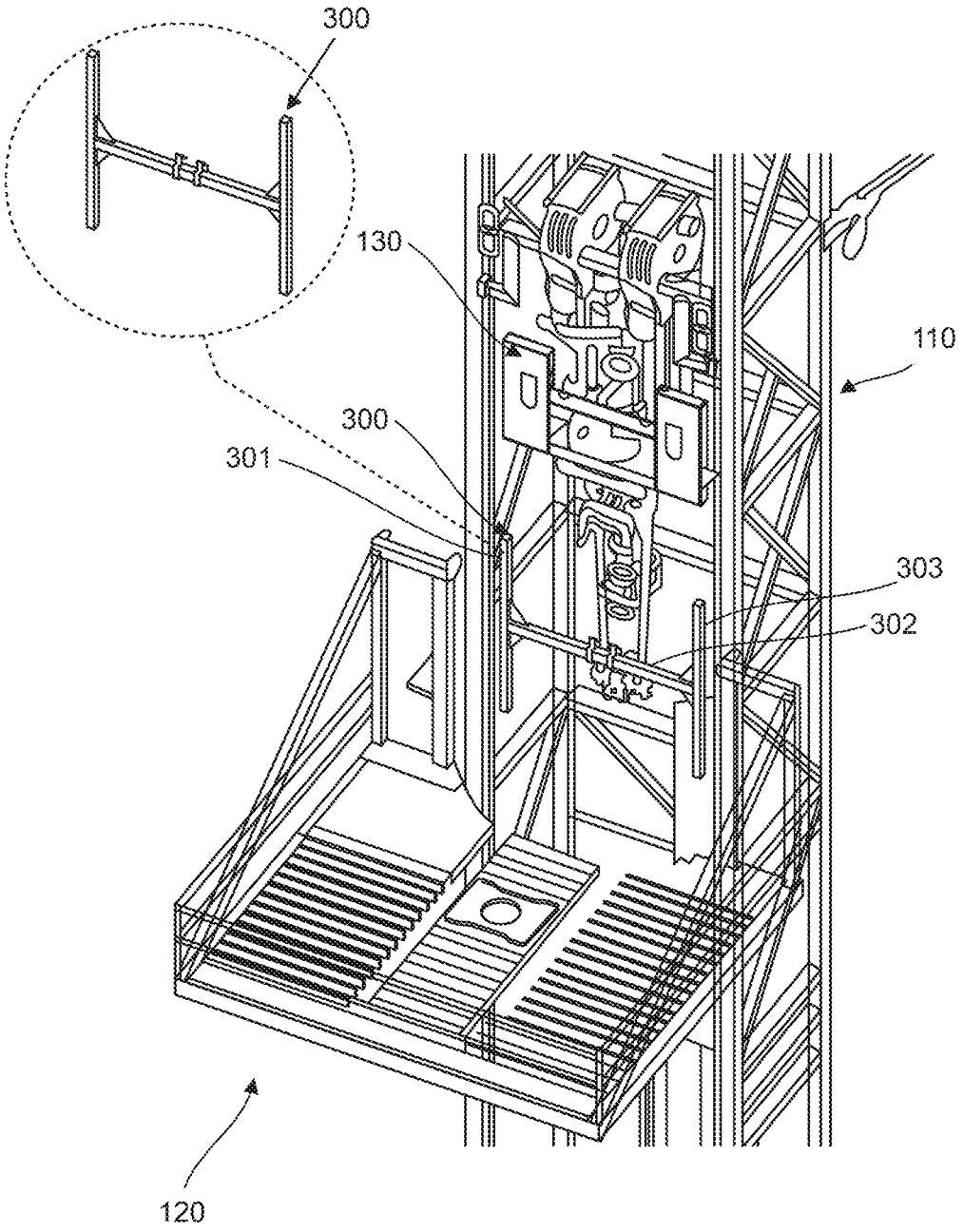
FIG. 3 depicts a dolly used in some embodiments of the present disclosure coupled to a mast.

With specific reference to step 707, the diving board (e.g., 240) may be coupled to the dolly of a traveling assembly (e.g., the traveling assembly 130, shown in FIGS. 3A and 3B). The diving board (e.g., 240) may be coupled to the dolly with a fastening system (e.g., the dolly 300 of FIG. 3). For example, the diving board (e.g., 240) may be coupled to the traveling assembly with a fastener received through a portion of a dolly and through the protrusion aperture (e.g., 254) and the pair of strut apertures of the diving board (e.g., 240). However, in other embodiments, the diving board may be coupled to the dolly through other means.

With specific reference to step 709, the diving board (e.g., 240) may be transported upward along the mast by the dolly toward the racking board (e.g., 220). Once the dolly is adjacent the racking frame (e.g., 221), the traveling assembly may be configured to automatically provide an alert signaling that the dolly is adjacent the racking frame (e.g., 221). The dolly may be stopped (e.g., automatically or manually) once the diving board (e.g., 240) is adjacent the racking frame (e.g., 221). The diving board (e.g., 240) may then be coupled to the racking frame (e.g., 221) before being decoupled from the dolly (e.g., by removing the fastener from step 310 from the diving board 240).

Once the diving board has been raised to the appropriate height, the diving board can be positioned and aligned with the racking frame. With specific reference to step 711, the diving board (e.g., 240) may then be coupled to the racking frame (e.g., 221). Specifically, one end of the diving board and the racking frame can be aligned so that the fasteners (e.g., 260) may be inserted along a Y-direction through the protrusion aperture (e.g., 254) and the pair of strut apertures as shown in FIGS. 2A-2C and as described above. Accordingly, the diving board 240 may be fixed in place along the X-Y plane relative to the strut (e.g., 222) but rotatable about a Y-axis about the fasteners (e.g., 260).

Referring to FIG. 5, the diving board 540 may be coupled to the racking board 520 by inserting the pins 560 of the racking board 520 into the slots 555 of the diving board 540. The diving board 540 may be rotated such that the body end 541 abuts against the sidewall 523. The pin 580 may be inserted through the aperture 554. In some embodiments, there may be a single pin 580 inserted through both of the apertures 554, however, in other embodiments, there may be a separate pin inserted through each of the apertures 554.

Turning back to FIGS. 2A-2C, once the diving board has been removably coupled to the racking frame, in step 713 the diving board is decoupled from the dolly or from the travelling assembly. In step 715, the dolly (if used) can be lowered, such as to the drilling rig floor, where the dolly can then be decoupled from the travelling assembly and rails of the mast, and then removed or stored for later use if needed.

Should the diving board (e.g., 240) be detached again (e.g., to repair or replace one or more components coupled to the diving board (e.g., 240) or change the diving board (e.g., 240) to an alternative diving board), the diving board (e.g., 240) may be decoupled from the racking frame (e.g., 221) by translating the fasteners (e.g., 260) along the Y-direction out of the protrusion aperture 254 and the pair of strut apertures (or, for the drilling rig assembly 500 in FIG. 5, by removing the pin 580 from the aperture 554 and translating the hooks 250 from the pins 560 along the Z-direction). The diving board (e.g., 240) may then be coupled to the traveling assembly by repeating the steps noted above in reverse order.

In some embodiments, the method 700 can further include replacing the raised racking board (e.g., 120) with a new one for repairing or other drilling related reasons. The replacing of the raised racking board (e.g., 120) can include lowering the raised racking board (e.g., 120) with the travelling assembly (e.g., 130) or the dolly (e.g., 140) of the travelling assembly. The steps of lowering can be similar to that of raising the racking board as discussed herein, but in reverse. For example, the replacing of the diving board can include decoupling the diving board from the racking board, coupling the diving board to the traveling assembly or the dolly, lowering the travelling assembly to the rig floor, decoupling the diving board from the travelling assembly or the dolly, coupling a new diving board to the travelling assembly or the dolly, and raising the new diving board to the first height with the travelling assembly. Furthermore, the new diving board can be aligned with the racking board, and the new diving board can be coupled to the racking board, as discussed above.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

Reference throughout this specification to "one example," "an example," "certain examples," or "exemplary implementation" means that a particular feature, structure, or characteristic described in connection with the feature and/or example may be included in at least one feature and/or example of claimed subject matter. Thus, the appearances of the phrase "in one example," "an example," "in certain examples," "in certain implementations," or other like phrases in various places throughout this specification are not necessarily all referring to the same feature, example, and/or limitation. Furthermore, the particular features, structures, or characteristics may be combined in one or more examples and/or features.

In the preceding detailed description, numerous specific details have been set forth to provide a thorough understanding of claimed subject matter. However, it will be understood by those skilled in the art that claimed subject matter may be practiced without these specific details. In other instances, methods and apparatuses that would be known by one of ordinary skill have not been described in detail so as not to obscure claimed subject matter. Therefore, it is intended that claimed subject matter not be limited to the particular examples disclosed, but that such claimed subject matter may also include all aspects falling within the scope of appended claims, and equivalents thereof.

What is claimed is:

1. A drilling rig assembly, comprising:

a mast;

a racking board removably coupleable to the mast, wherein the racking board has a first end and further comprises a first plurality of fasteners located at the first end of the racking board and a racking frame having a first end surface, wherein the first plurality of fasteners includes strut receptacles extending from the racking frame, each strut receptacle defining a channel; and a diving board having a first end and a second end, the second end being configured to be raised or lowered along the mast separately from the racking board, wherein the first end of the diving board is configured to removably couple to the racking board, wherein the first end of the diving board comprises a first end surface and a second plurality of fasteners including angular protrusions angularly extending from a diving board body, wherein the first end surface is adapted to rest against the first end surface of the racking frame and each of the angular protrusions are receivable within the channels defined by the strut receptacles.

2. The drilling rig assembly according to claim 1, wherein at least one pin extends through an aperture in each of the second plurality of fasteners, and through an aperture in each of the first plurality of fasteners to couple the diving board to racking board.

3. The drilling rig assembly according to claim 1, wherein the diving board comprises a robot coupled thereto.

4. The drilling rig assembly according to claim 3, wherein the robot is adapted to perform at least one of the following: grip, raise, lower, move, or handle drill pipe.

5. The drilling rig assembly of claim 1, further comprising: a traveling assembly coupled to the mast and configured to move the diving board up and down along a length the mast.

6. The drilling rig assembly of claim 5, wherein:

the traveling assembly includes a dolly movably coupled to the mast; and the diving board is configured to be removably coupled to the dolly.

7. The drilling rig assembly of claim 6, wherein the dolly comprises a pair of arms moveable coupled to the mast.

8. The drilling rig assembly of claim 7, wherein the dolly comprises a cross beam extending between the pair of arms.

9. The drilling rig assembly of claim 6, wherein the dolly is coupled to a top drive and configured to be lifted up and down a length of the mast.

10. The drilling rig assembly of claim 6, wherein the diving board is removably couplable to the dolly to raise the diving board to a specified height of the racking board.

11. The drilling rig assembly of claim 10, further comprising an alert means for indicating the diving board has reached the specified height of the racking board and is coplanar with the racking board.

12. The drilling rig assembly of claim 1, wherein each of the angular protrusions of the diving board comprises: a hook configured to couple with the racking frame and the strut receptacle.

13. The drilling rig assembly of claim 12, wherein the hook comprises a slot and an aperture, wherein the slot is configured to couple with the racking frame and the aperture of the hook is received within the channel of the strut receptacles.

14. A racking board for a drilling rig comprising a removable diving board, the removable diving board comprising:

a body having a first end and a second end, wherein the first end comprises a first coupling mechanism and a second coupling mechanism, wherein the first coupling mechanism is adapted to removably couple with a first coupling mechanism of the racking board at a corresponding first end of the racking board, wherein the second coupling mechanism of the removable diving board comprises a plurality of openings and a corresponding plurality of extendable pins, wherein each of the plurality of extendable pins is adapted to extend from a first, unextended position to a second, extended position, and wherein when the plurality of extendable pins is in the second position, each of the plurality of extendable pins extends through one of the plurality of openings, and an automatic extension mechanism to automatically move the plurality of extendable pins from a first position to a second position in response to a user input.

15. The racking board according to claim 14, further comprising: a plurality of members having slots therein, wherein the first coupling mechanism of the racking board comprises a plurality of bars attached thereto, wherein each of the slots are adapted to removably receive one of the plurality of bars attached to the racking board.

16. A drilling rig assembly, the assembly comprising:

a mast;

a racking board, wherein the racking board is configured to be removably coupled to the mast; and a diving board, wherein the diving board is configured to be removably coupled to the racking board, wherein the diving board comprises a first end proximal a first end of the racking board and distal the mast and a second end proximal the mast, and wherein the first end of the diving board comprises a plurality of hooks, each of the plurality of hooks having an opening therethrough and a slot on a bottom side thereof, wherein each slot is configured to removably hold one or more support members and each opening is configured to removably hold a pin therein when the diving board is coupled with the racking board.

17. The drilling rig assembly of claim 16, wherein the one or more support members comprise one or more bars attached to the racking board.

18. The drilling rig assembly of claim 17, wherein the one or more bars are attached to one or more struts attached to the racking board.

19. The drilling rig assembly of claim 16, wherein the first end of the diving board further comprises one or more pins attached thereto, wherein each of the one or more pins are adapted to fit into one or more openings in one or more support members of the racking board when the diving board is removably coupled with the racking board.

* * * * *